US008128850B2

(12) United States Patent
Goda et al.

(10) Patent No.: US 8,128,850 B2
(45) Date of Patent: Mar. 6, 2012

(54) METHOD OF PRODUCING ISLANDS-IN-SEA TYPE COMPOSITE SPUN FIBER

(75) Inventors: Hironori Goda, Matsuyama (JP); Miyuki Numata, Matsuyama (JP); Mie Kamiyama, Matsuyama (JP); Nobuyuki Yamamoto, Osaka (JP); Tamio Yamamoto, Matsuyama (JP)

(73) Assignee: Teijin Fibers Limited, Osaka (JP)

( * ) Notice: Subject to any disclaimer, the term of this patent is extended or adjusted under 35 U.S.C. 154(b) by 337 days.

(21) Appl. No.: 12/088,659

(22) PCT Filed: Sep. 28, 2006

(86) PCT No.: PCT/JP2006/319909

§ 371 (c)(1),
(2), (4) Date: Mar. 28, 2008

(87) PCT Pub. No.: WO2007/037512

PCT Pub. Date: Apr. 5, 2007

(65) Prior Publication Data

US 2009/0042031 A1 Feb. 12, 2009

(30) Foreign Application Priority Data

Sep. 29, 2005 (JP) ..... 2005-283966

(51) Int. Cl.

| | |
|---|---|
| ***D01D 5/12*** | (2006.01) |
| ***D01D 5/36*** | (2006.01) |
| ***D01F 8/14*** | (2006.01) |
| ***D02J 1/22*** | (2006.01) |

(52) U.S. Cl. ..... 264/172.13; 264/210.7; 264/210.8; 264/211.17

(58) Field of Classification Search ..... 264/172.13, 264/210.7, 210.8, 211.17
See application file for complete search history.

(56) References Cited

U.S. PATENT DOCUMENTS

| | | | | |
|---|---|---|---|---|
| 5,202,185 | A | 4/1993 | Samuelson | |
| 5,204,041 | A | 4/1993 | Tashiro et al. | |
| 5,637,385 | A | 6/1997 | Mizuki et al. | |
| 6,245,268 | B1 * | 6/2001 | Oka et al. | 264/172.13 X |
| 6,506,873 | B1 | 1/2003 | Ryan et al. | |
| 6,761,970 | B2 | 7/2004 | Ochi et al. | |
| 6,783,854 | B2 | 8/2004 | Bond | |

(Continued)

FOREIGN PATENT DOCUMENTS

EP 1 731 634 A1 12/2006

(Continued)

OTHER PUBLICATIONS

Information Statement dated Jun. 15, 2010, filed in corresponding Japanese Patent Application No. 2007-537768.

(Continued)

*Primary Examiner* — Leo B Tentoni
(74) *Attorney, Agent, or Firm* — Sughrue Mion, PLLC

(57) ABSTRACT

The method of producing an islands-in-sea type composite spun fiber having an island component diameter of 1 μm or less according to the present invention comprises drawing (superdrawing) with a total draw ratio of from 5 to 100 an undrawn islands-in-sea type composite spun fiber having been prepared by spinning at a spinning speed of from 100 to 1,000 m/min, at temperatures higher than the glass transition points of both the polymer forming the sea component and the polymer forming the island components of the composite spun fiber.

8 Claims, 1 Drawing Sheet

U.S. PATENT DOCUMENTS

| | | | | |
|---|---|---|---|---|
| 6,821,612 | B1 * | 11/2004 | Melik et al. | 264/210.7 X |
| 2004/0209077 | A1 | 10/2004 | Yoon et al. | |
| 2006/0182960 | A1 | 8/2006 | Suzuki | |

FOREIGN PATENT DOCUMENTS

| | | | |
|---|---|---|---|
| JP | 47-032127 | A | 11/1972 |
| JP | 51-55420 | A | 5/1976 |
| JP | 61-052243 | B | 11/1986 |
| JP | 1-282390 | A | 11/1989 |
| JP | 05-222668 | A | 8/1993 |
| JP | 07-258940 | A | 10/1995 |
| JP | 11-247027 | A | 9/1999 |
| JP | 2000-96377 | A | 4/2000 |
| JP | 2000-342501 | A | 12/2000 |
| JP | 2002-004130 | A | 1/2002 |
| JP | 2004-162244 | A | 6/2004 |
| JP | 2005-325494 | A | 11/2005 |
| JP | 2007-009339 | A | 1/2007 |
| RU | 2044804 | C1 | 9/1995 |
| WO | 02-088438 | A1 | 11/2002 |
| WO | 2004/038073 | A1 | 5/2004 |
| WO | 2004/085723 | A1 | 10/2004 |
| WO | 2005/095686 | A1 | 10/2005 |

OTHER PUBLICATIONS

Seni Gakkai shi, "Gokuboso Senni ni tuite" vol. 32, No. 9, p. 318, Aug. 10, 1976.

Gousei Seni (I) Nylon and Tetoron, pp. 314-315, Nov. 10, 1960, 2nd edition Sangyo Yosho K.K.

Chinese Office Action dated May 27, 2010 for corresponding Chinese Application No. 200680036177.0.

Yun-Cheng Li et al., Production of Polymer Yarn, 2nd Edition, China Textile and Apparel Press, Apr. 1998, pp. 444-446.

Hai-xia Zhou, The Study of Water-Solubility Polyester Sea-Island Fiber, Dissertation for Master's Degree of Donghua University, 2004.

* cited by examiner

METHOD OF PRODUCING ISLANDS-IN-SEA TYPE COMPOSITE SPUN FIBER

FIELD OF THE INVENTION

The present invention relates to a method of producing an islands-in-sea type composite spun fiber the island components of which each have a diameter of 1 μm or less, and from which ultrafine fibers each having a fiber diameter of 1 μm or less can be obtained by extracting and removing the sea component.

BACKGROUND ART

Ultrafine fibers with a fiber diameter of 1,000 nm (=1 μm) or less as represented by a nanofiber that is defined to have a fiber diameter of from 1 to 100 nm have recently received attention as a subject to be studied. Specifically, investigations have been made into the use of ultrafine fibers for ultrahigh performance filters, separators of batteries, capacitors, and the like, grinding materials for hard discs, silicon wafers, and the like, and raw materials for high performance materials, because of their unusuality with respect to hygroscopicity, a tendency to absorb low molecular weight materials, and the like.

It is described that according to the system of extracting the sea component of fibers in a polymer alloy yarn, 60% or more of the island component domain is capable of producing ultrafine fibers having a diameter of from 1 to 150 nm (e.g., see Japanese Unexamined Patent Publication (Kokai) No. 2004-169261). However, because the island components are finely dispersed in the polymer alloy method (or incorporated spinning method), selection of two types or more of polymers that have solubility parameters (defined as (evaporation energy/molecular volume)$^{1/2}$, also termed SP values) close to each other and that are incompatible is required. As a result, selection of the types of the polymers in accordance with the purpose, for example, making a polymer that forms the sea component and a polymer that forms the same island components, and selection of the copolymer components and physical properties such as an intrinsic viscosity cannot be made optionally. Moreover, because the islands-sea boundary area is significantly increased, a Barus phenomenon in which polymer flows after injection from the spinneret expands takes place. As a result, spinning stability-related problems such as formation of foreign materials on the face of the spinneret and poor stringiness arise. Furthermore, uniformity of the island diameter is far from being termed uniform as observed in the figures in Japanese Unexamined Patent Publication (Kokai) No. 2004-169261, and production of ultrafine fibers at the nanolevel as filaments yarn and short fibers having a uniform length has been impossible.

On the other hand, an electrospinning method of obtaining a fiber having a diameter of from a few nanometers to a few micrometers is illustrated (e.g., see the specification of U.S. Pat. No. 1,975,504). The procedure for obtaining an extremely fine fiber comprises applying a high voltage of from 2 to 20 kV between the tip of a nozzle containing a polymer solution and a base plate, whereby a charged polymer is injected from the tip of the nozzle at the instant when the electric repulsive force exceeds the surface tension, and collecting the injected polymer on the base plate. However, the electrospinning method has the following problems: the polymer to be used is restricted to one that has good solvent having a boiling point near 110° C.; the resultant nanofiber has a problem of size uniformity (e.g., a fiber as thick as 1 μm or more in diameter is mixed in the nanofiber); because the melt viscosity is required to be low to a certain degree, a high strength fiber cannot be obtained. Furthermore, in order to produce the fiber in an industrial production amount by currently published production methods, a spinneret having multi-nozzles and a base plate having a significantly large plate area are required. In other words, many unsolved problems still remain. Still furthermore, production of a filaments yarn and production of short fibers having an optional length are impossible.

Other methods of producing an ultrafine fiber having a diameter of 1 μm or less include a melt blowing method comprising blowing a molten thermoplastic polymer with a high speed air flow to form a fiber, and a flash spinning method comprising injecting a polymer solution at the moment when the polymer solution prepared by dissolving a polymer in a solvent at high temperature and high pressure is made gaseous, to form a net-like fiber. However, as in the electrospinning method, these methods have the problem that the fiber diameter is not uniform and the problem that a filament yarn cannot be obtained (see, e.g., Basics and Applications of Nonwoven Fabrics P. 107-127 (1993), edited by the Textile Machinery Society of Japan).

Furthermore, it is well known that extremely fine fibers of island components can be obtained by extracting and removing the sea component of an islands-in-sea type composite spun fiber obtained by compositing at least two types of molten polymers within a spinneret. However, the lower limit of the fiber diameter is at most at the level of 2 μm (0.03 dtex for a poly(ethylene terephthalate)). Obtaining an island diameter of 1 μm or less has been extremely difficult (e.g., see "Newest Spinning Technologies" 215 (1992), edited by the Society of Fiber Science and Technology, Japan).

Accordingly, neither a method of producing ultrafine filament yarns having a fiber diameter of 1 μm or less and a uniform fiber diameter distribution nor a method of producing ultrafine short fibers having equal fiber lengths has been proposed.

DISCLOSURE OF THE INVENTION

Based on the above technological background, the present invention has been achieved. An object of the present invention is to provide a production method that does not require selection of the polymer type, and that is capable of giving with high productivity ultrafine fibers having a uniform fiber diameter and composed of filaments yarn or short fibers of equal fiber length.

The above object can be achieved by a method of producing an islands-in-sea type composite spun fiber having an island component diameter of 1 μm or less according to the present invention, the method comprising drawing with a total draw ratio of from 5 to 100 an undrawn islands-in-sea type composite spun fiber that has been spun at a spinning speed of from 100 to 1,000 m/min at temperatures higher than the glass transition points of both of the polymers forming the sea component and the island components of the islands-in-sea type composite spun fiber.

In the method of producing an islands-in-sea type composite spun fiber according to the present invention, after the drawing, the islands-in-sea type composite spun fiber is preferably subjected to a constant-length heat treatment at temperatures higher than the glass transition points of both of the polymers forming the sea component and the island components of the islands-in-sea type composite spun fiber with a fiber length made from 0.90 to 1.10 times the drawn fiber length.

In the method of producing an islands-in-sea type composite spun fiber according to the present invention, after the drawing, the islands-in-sea type composite spun fiber is preferably additionally drawn (neck drawn).

In the method of producing an islands-in-sea type composite spun fiber according to the present invention, after the neck drawing, the fiber is preferably subjected to constant-length heat treatment with the fiber length made from 0.90 to 1.10 times the neck drawn fiber length at temperatures higher than the glass transition points of both of the polymers forming the sea component and the island components of the islands-in-sea type composite spun fiber.

In the method of producing an islands-in-sea type composite spun fiber according to the present invention, after the drawing, the islands-in-sea type composite spun fiber is sometimes preferably subjected to neither constant-length heat treatment with the length made from 0.90 to 1.10 times the drawn fiber length at temperatures higher than the glass transition points of both of the polymers forming the sea component and the island components of the islands-in-sea type composite spun fiber, nor additional drawing (neck drawing).

In the method of producing an islands-in-sea type composite spun fiber according to the present invention, the drawing is preferably conducted at temperatures higher than the glass transition points of both of the polymers forming the sea component and the island components of the islands-in-sea type composite spun fiber by 10° C. or more.

In the method of producing an islands-in-sea type composite spun fiber according to the present invention, both of the polymers forming the sea component and the island components preferably contain a polyester polymer.

In the method of producing an islands-in-sea type composite spun fiber according to the present invention, the polymer forming the sea component is preferably a poly(ethylene terephthalate) copolymerized polyester in which an alkali metal of 5-sulfoisophthalic acid and/or a poly(ethylene glycol) is copolymerized, and the polymer forming the island components is preferably a poly(ethylene terephthalate) copolymerized polyester in which a poly(ethylene terephthalate) or isophthalic acid and/or an alkali metal salt of 5-sulfoisophthalic acid is copolymerized.

In the method of producing an islands-in-sea type composite spun fiber according to the present invention, the number of island components is preferably from 10 to 2,000.

The ultrafine fibers according to the present invention are ones with a fiber diameter of 1 μm or less obtained by dissolving and removing the sea component from the islands-in-sea type composite spun fiber obtained by any one of the methods of producing an islands-in-sea type composite spun fiber according to the present invention.

The present invention makes it possible to obtain a filaments yarn having a diameter of 1 μm or less or short fibers having an optional fiber length with high productivity. Moreover, ultrafine fibers that have been obtained only in the state of a nonwoven fabric in which a fiber-to-fiber is fixed can be easily made a woven or knitted fabric, or they can be easily stacked to form a nonwoven fabric or a fiber structure material by the present invention.

BEST MODE FOR CARRYING OUT THE INVENTION

The embodiments of the present invention are explained below in detail.

The method of producing an islands-in-sea type composite spun fiber having an island component diameter of 1 μm or less according to the present invention comprises drawing with a total draw ratio of from 5 to 100 an undrawn islands-in-sea type composite spun fiber (hereinafter also termed superdrawing) that has been spun at a spinning speed of from 100 to 1,000 m/min, at temperatures higher than the glass transition points of both of the polymers forming the sea component and the island components of the islands-in-sea type composite spun fiber.

Figure 1:
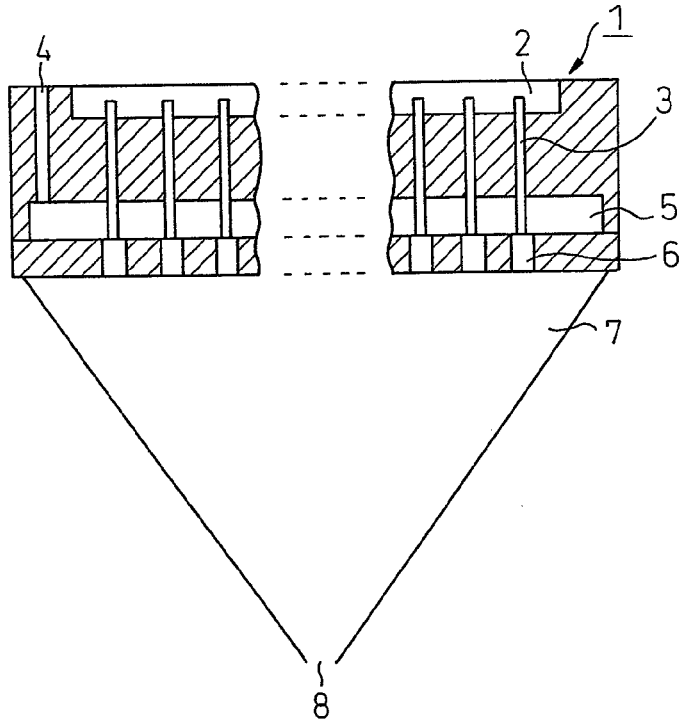
FIG. 1 is a schematic fragmentary sectional view showing one embodiment of a spinneret used for conducting the method of producing an island-in-sea type composite spun fiber of the present invention.
Figure 2:
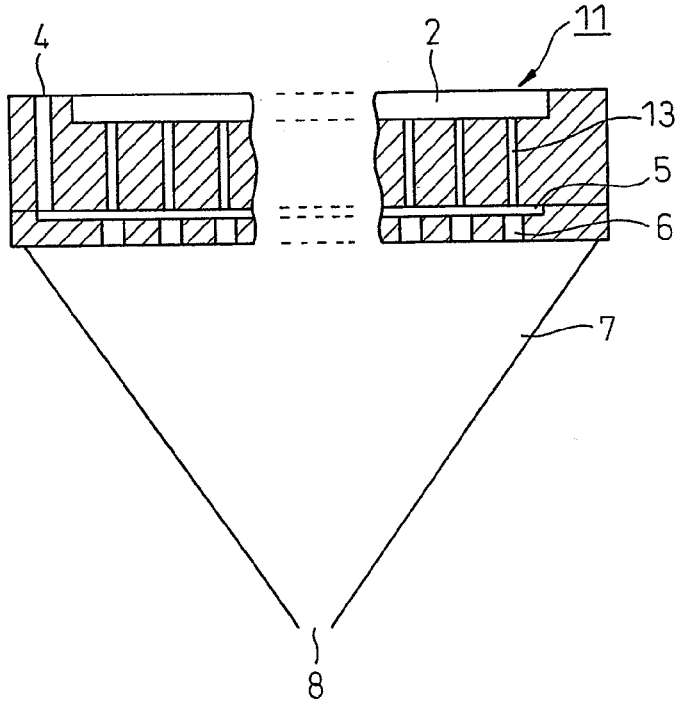
FIG. 2 is a schematic fragmentary sectional view showing another embodiment of a spinneret used for conducting the method of producing an island-in-sea type composite spun fiber of the present invention.

The undrawn islands-in-sea type composite spun fiber is preferably prepared by such a procedure as explained below. Using a known spinneret for an islands-in-sea type composite fiber such as ones described in FIG. 1 and FIG. 2, a polymer to form a sea component and a polymer to form island components, both polymers being melted separately, are composited, and injected through a nozzle. A spinneret having a group of hollow pins, a spinneret having a group of fine pores, or the like spinneret can be suitably used as such a spinneret. Any spinneret can be used as long as an islands-in-sea type composite spun fiber can be formed by, for example, combining island component flows extruded from hollow pins or fine pores and sea component flows fed from flow paths that are designed to fill the spaces among the island component flows, and extruding the combined flows from an injection nozzle while the combined flows are being gradually thinned. Embodiments of the spinneret preferably used are shown in FIG. 1 and FIG. 2, respectively. However, spinnerets that can be used in the method of the invention are not necessarily restricted thereto.

For a spinneret 1 shown in FIG. 1, a polymer (molten material) for island components in a polymer pool 2 for island components prior to distribution is distributed into polymer introduction paths 3 for island components formed with a plurality of hollow pins. On the other hand, a polymer (molten material) for a sea component is introduced into a polymer pool 5 for a sea component prior to distribution through a polymer introduction path 4 for a sea component. The hollow pins forming polymer introduction paths 3 for island components each pass through the polymer pool 5 for a sea component, and are open downward in the central portion of each inlet of a plurality of paths 6 for core-sheath composite flows formed under the polymer pool 5. Island component polymer flows are introduced into the respective central portions of the paths 6 for core-sheath composite flows from the lower ends of the polymer introduction paths 3 for island components; the polymer flows for a sea component in the polymer pool 5 for a sea component are introduced into the respective paths 6 for core-sheath composite flows in such a manner that the polymer flows each surround an island component polymer flow. As a result, core-sheath composite flows wherein the island component polymer flows each form a core, and the sea component polymer flows each form a sheath. A plurality of core-sheath composite flows are then introduced into a funnel-like combined flow path 7 where adjacent sheath portions of the plurality of core-sheath composite flows are bonded together to form an islands-in-sea type composite flow. The cross-sectional area of the islands-in-sea type composite flow in the horizontal direction is gradually reduced while it is flowing down the funnel-like combined path 7, and the flow is injected through an injection nozzle 8 at the lower end of the combined flow path 7.

For a spinneret 11 shown in FIG. 2, an island component polymer pool 2 is connected to a sea component polymer pool 5 through introduction paths 13 for an island component polymer composed of a plurality of through-holes. An island component polymer (molten material) in the island component polymer pool 2 is distributed into the plurality of introduction paths 13 for an island component polymer, and introduced into the sea component polymer pool 5 through the introduction paths 13. The introduced island component polymer flows pass through the sea component polymer (molten material) contained in the sea component polymer pool 5, flow into a plurality of paths 6 for core-sheath composite flows, and flow down the central portion. On the other hand, the sea component polymer in the sea component polymer pool 5 flows down the paths 6 for core-sheath composite flows in such a manner that the sea component polymer surrounds each island component polymer flow that flows down the central portion. As a result, a plurality of core-sheath composite flows are formed in the plurality of paths 6 for core-sheath composite flows, flow down a funnel-like combined flow paths 7 to form an islands-in-sea type composite flow in the same manner as in the spinneret in FIG. 1. The composite flow flows down while the cross-sectional area in the horizontal direction of the flow is being reduced, and is injected through the injection nozzle 8.

The injected islands-in-sea type composite flow is taken up with a rotary roller or an ejector set at a given taking-up speed while being solidified with cooling air blown thereover to give an undrawn islands-in-sea type composite spun fiber. Although there is no specific restriction on the weight ratio of sea to islands in the undrawn islands-in-sea type composite spun fiber, the ratio of the sea component:the island components is preferably from 10:90 to 80:20, particularly preferably from 20:80 to 70:30. When the weight proportion of the sea component exceeds 80% by weight, an amount of a solvent necessary for dissolving the sea component becomes large, and problems about safety, environmental impacts and the production cost arise. Furthermore, when the weight proportion is less than 10% by weight, there are possibilities that the island components stick together.

Although the number of the island components in the islands-in-sea type composite spun fiber should be determined while the productivity and a desired fiber diameter of the ultrafine fibers, and the dissolution extractability of the polymer forming the sea component are taken into consideration, the preferred range is from 10 to 2,000. When the number of the island components is 9 or less, in order to obtain an island fiber having a diameter of 1 μm or less (depending on a desired fiber diameter though), the fiber diameter of the parent fiber is required to be thinner. Then, the injection amount is lowered during spinning or the spinning speed or the draw ratio is increased. Therefore, there is a restriction on the spinnability. The upper limit of the number of the island components is preferably 2,000 or less for reasons such as an increase in the production cost of the spinneret, lowering of the processing accuracy and difficulty in extracting the polymer forming the sea component in the parent fiber central portion. Moreover, the number of the island components is preferably from 15 to 1,000. In order to obtain finer island fibers with high productivity, the number of the island components is preferably larger. The number is more preferably from 100 or more to 1,000 or less.

Drawing procedures such as laser drawing and zone drawing are known as the methods of subsequently drawing the undrawn islands-in-sea type composite spun fiber with a high draw ratio. However, a technology of drawing at high speed or efficiently drawing in a tow state has not been established yet. A method of superdrawing the undrawn islands-in-sea type composite spun fiber in a hot medium bath such as hot water or hot silicone oil at temperatures of the glass transition point or more and less than the melting point of the polymer is most suitable as the method that can draw the undrawn fiber in a high draw ratio with high productivity. Use of hot water is preferred in view of the environment and cost.

In order to conduct superdrawing in a hot medium as shown above, a specific type of the polymer is not required as long as the undrawn islands-in-sea type composite spun fiber is formed from an amorphous polymer or a crystalline polymer with an adequately small crystallinity. However, it is important that both the polymer forming the sea component and the polymer forming the island components be selected so that they can be superdrawn. In particular, it is preferred that the polymer forming the sea component and the polymer forming the island components each contain a polyester polymer. Furthermore, a poly(ethylene terephthalate) polyester is particularly preferred for the following reasons: because it has a glass transition point adequately higher than room temperature and lower than the boiling point of water, the undrawn islands-in-sea type composite spun fiber is likely to freeze in an amorphous state, and can be readily superdrawn in hot water. For the poly(ethylene terephthalate) polyester, in addition to a poly(ethylene terephthalate), an aromatic dicarboxylic acid component such as isophthalic acid, 2,6-naphthalenedicarboxylic acid or 5-sodiosulfoisophthalic acid, an aliphatic dicarboxylic acid component such as adipic acid, sebacic acid, azelaic acid or dodecanoic acid, an alicyclic dicarboxylic acid component such as 1,4-cyclohexanedicarboxylic acid, a hydroxycarboxylic acid or its condensation products such as ϵ-caprolactone, a carboxyphosphinic acid such as 2-carboxyethyl-methylphosphinic acid or 2-carboxyethyl-phenylphosphinic acid or cyclic anhydrides of these compounds, a diol such as 1,3-propanediol, 1,4-butanediol, 1,5-pentanediol, 1,6-hexanediol, diethylene glycol, 1,4-cyclohexanediol or 1,4-cyclohexanedimethanol, a poly(alkylene glycol) such as a poly(ethylene glycol), a poly(trimethylene glycol) or a poly(tetramethylene glycol), and the like compounds may be copolymerized in such a range that the superdrawability is not hindered.

In particular, the polymer forming the sea component and the polymer forming the island components are required to be selected while the formability of the islands-in-sea cross section and the elutability of the polymer forming the sea component are being taken into consideration. The polymer forming the sea component preferably has a melt viscosity higher than that of the polymer forming the island components. Moreover, the polymer forming the sea component is preferably dissolved or decomposed in a specific solvent or decomposition chemical at a rate at least 100 times as high as that of the polymer forming the island components. Specific examples of the solvent or decomposition chemical include an aqueous alkaline solution (aqueous potassium hydroxide solution, aqueous sodium hydroxide solution, and the like) for a polyester, formic acid for an aliphatic polyamide such as nylon 6 and nylon 66, trichloroethylene or the like for a polystyrene, a hydrocarbon solvent such as hot toluene and xylene for a polyethylene (conventional low density polyethylene and linear low density polyethylene), or hot water for a poly(vinyl alcohol) and an ethylene-modified vinyl alcohol polymer.

Of polyester polymers, particularly preferred examples of the polymer forming the sea component include a poly(ethylene terephthalate) copolymerized polyester in which an alkali metal salt of 5-sulfoisophthalic acid in an amount of 3 to 12% by mole based on the total repeating units of the polyester polymer and/or a poly(ethylene glycol) having a molecular weight of from 4,000 to 12,000 in an amount of 3 to 10% by weight based on the total weight thereof are copolymerized for the following reasons: the copolymerized polymer is dissolved in an alkali solution at a high rate and has a high melt viscosity during spinning. The intrinsic viscosity of the poly(ethylene terephthalate) type copolymerized polyester is preferably from 0.4 to 0.6 dl/g. The alkali metal salt of 5-sulfoisophthalic acid herein contributes to the improvement of hydrophilicity and melt viscosity, and the poly(ethylene glycol) (PEG) improves the hydrophilicity. 5-Sodiosulfoisophthalic acid is preferred as the alkali metal salt of 5-sulfoisophthalic acid. Copolymerization of the alkali metal salt of 5-sulfoisophthalic acid in an amount of less than 3% by mole is not preferred because the effect of improving hydrophilicity is not significant; copolymerization thereof in an amount exceeding 12% by mole is not preferred because the melt viscosity becomes excessively high. Furthermore, a PEG acts to increase the hydrophilicity with an increase in the molecular weight. The action is estimated to be caused by the higher-order structure. However, the reactivity becomes poor, and the copolymerized polyester becomes a blend system. As a result, there are the possibilities that problems concerning heat resistance and spinning stability may arise. Moreover, copolymerization of a PEG in an amount exceeding 10% by weight is not preferred because the PEG lowers the melt viscosity; copolymerization thereof in an amount less than 3% by weight is not preferred because reduction with an aqueous alkali solution becomes poor. From the above explanation, the range mentioned above is considered to be appropriate.

On the other hand, particularly preferred examples of the polymer forming the island components include a poly(ethylene terephthalate) polyester in which a poly(ethylene terephthalate) or isophthalic acid and/or an alkali metal salt of 5-sulfoisophthalic acid is copolymerized in an amount of 20% by mole or less based on the total repeating units of the poly(ethylene terephthalate) polyester. 5-Sodiosulfoisophthalic acid is preferred as the alkali metal salt of 5-sulfoisophthalic acid for the following reasons: the polyester thus obtained has superdrawability and satisfies the above conditions related to the melting viscosity; and the polyester has adequate strength after drawing. Copolymerization of isophthalic acid and/or an alkali metal salt of 5-sulfoisophthalic acid in an amount exceeding 20% by mole is not preferred sometimes because the melt viscosity increases or the strength cannot be ensured.

In addition, the polymer forming the sea component and the polymer forming the island components may optionally contain, as long as the spinnability and the physical properties of the ultrafine short fibers after extraction are not influenced, various additives such as organic fillers, antioxidants, thermal stabilizers, light stabilizers, flame retardants, lubricants, antistatic agents, rust preventives, crosslinking agents, expanding agents, fluorescent agents, surface lubricating agents, surface gloss improvers or releasing improvers (such as fluororesin).

In order to increase the superdrawing ratio, a suitably decreased molecular weight of the polyester is preferred because entanglement of the molecules is decreased. For example, for a poly(ethylene terephthalate) polyester, an intrinsic viscosity (representative physical properties) of from about 0.3 to 0.8 dl/g is a particularly preferred range. Moreover, when the polyester contains large amounts of impurities and copolymerization components to a certain degree, the crystallinity and molecular orientation are likely to be lowered. The amounts may therefore be suitably adjusted in accordance with a desired superdrawing ratio. For the poly(ethylene terephthalate) polyester, examples of the materials include diethylene glycol produced as an unreacted product of ethylene glycol during condensation polymerization, and a poly(alkylene glycol) for improving the alkali reduction. Typical examples of the copolymerized products are as mentioned above.

Furthermore, in order to increase the superdrawing ratio, it is important to make the molecular orientation in the undrawn islands-in-sea type composite spun fiber as small as possible. Therefore, the spinning draft is required to be made small. In order to make the spinning draft small, there is means of making the injection nozzle of a spinneret small or decreasing the spinning speed when an amount of the molten polymer injected through the spinneret is constant. Moreover, for the islands-in-sea type composite spun fiber, because formation of the islands-in-sea cross section becomes difficult when the injection nozzle is made small, control of the spinning speed is desirable. A spinning speed of from 100 to 1,000 m/min is preferred. When the spinning speed exceeds 1,000 m/min, the molecules are highly oriented. As a result, extending the entanglement of a molecular chain during superdrawing becomes difficult, and the draw ratio cannot be increased. On the other hand, when the spinning speed is less than 100 m/min, the molecular orientation becomes isotropic, and there is no molecular orientation in the fiber axis direction caused by a suitable draft. As a result, the superdrawing ratio decreases on the contrary. A more preferred spinning speed is from 300 to 700 m/min. Moreover, in the present invention, either a multifilament yarn-like fiber or a tow-like fiber can be used as the undrawn islands-in-sea type composite spun fiber. Furthermore, an undrawn islands-in-sea type composite spun fiber as thin as 5 dtex or less can be used.

When the undrawn islands-in-sea type composite spun fiber obtained as explained above is drawn at temperatures higher than the glass transition points (hereinafter described as "$T_g$") of both of the polymer forming the sea component and the polymer forming the island components, a superdrawing phenomenon takes place, and drawing with a high ratio involving no significant molecular orientation is made possible. The procedure is an effective drawing method when a single filament size is to be made thin. For usually conducted neck drawing, the possible maximum draw ratio has a constant upper limit determined by spinning conditions. Stabilized neck drawing with a ratio higher than that is substantially impossible. However, superdrawing makes drawing with a high ratio possible. Therefore, a thin denier fiber can be easily produced.

The total draw ratio of the superdrawing is determined to be from 5 to 100. When the draw ratio is less than 5, the advantage of thinning the island fibers and improving the productivity as a result of increasing the draw ratio is not significant in comparison with the conventional neck drawing. When the draw ratio exceeds 100, a tension appropriate to superdrawing is then hardly maintained. The draw ratio is preferably from 10 to 90, particularly preferably from 20 to 85. Because a draw ratio in a wide range can be employed in drawing by superdrawing according to the invention, a draw ratio in a wide range can be selected in accordance with the denier a fiber product required to have.

In order to make more stabilized superdrawing take place, it is desirable to conduct superdrawing at temperatures higher than the $T_g$ of either one of both polymers forming the sea component and the island components by 10° C. or more. For example, for a composite fiber in which both the sea component and the island components are polyester, superdrawing is preferably conducted in a hot water bath at temperatures of from 80 to 100° C. or in a steam bath at 100° C. Because an undrawn islands-in-sea type composite spun fiber as explained above is used in the present invention, superdrawing is preferably conducted at the temperatures. However, because uniform heat transfer necessary for superdrawing to the undrawn islands-in-sea type composite spun fiber is difficult when the fiber is in a dry state, uniform superdrawing at the temperatures is difficult. Furthermore, at the temperatures, superdrawing in which a molecular orientation change less takes place with a tension as low as 0.1 cN g/dtex or less (usually from 0.02 to 0.05 cN/dtex) can be conducted. Although the resident time of the fiber in the drawing bath changes depending on the bath temperature and the polymer constitution of the fiber, generally a resident time of 0.1 sec or more, preferably 0.5 sec or more is sufficient. The drawing speed can therefore be increased. Moreover, because fibers are likely to stick together during superdrawing, surface active agents or the like having the effect of preventing sticking should be made to be present on the fiber surface.

Next, because a superdrawn polyester fiber has physical properties similar to an undrawn fiber, the fiber is preferably neck drawn subsequently to superdrawing for the purpose of improving the physical properties or further decreasing the size. Neck drawing different from the above superdrawing is not required to be conducted at temperatures higher than the $T_g$ of either one of both of the polymers forming the sea component and the island components. Moreover, when a low orientation yarn such as a binder fiber is required, neck drawing is unnecessary. A conventional neck drawing method can be adopted. Therefore, cold drawing in which the fiber is drawn at temperatures of $T_g$ or less of the polymers forming the fiber may be conducted. Although the neck drawing ratio is determined by the orientation of the fiber having been superdrawn, the ratio is usually from 1.5 to 4.0. For a polyester fiber, neck drawing is preferably conducted with a draw ratio of from about 2.5 to 4.0 in a drawing bath at temperatures of from 60 to 80° C. Because the neck drawing temperature is low in comparison with the superdrawing temperature, the fiber is preferably cooled with a cooling roller, cold water, or the like between superdrawing and neck drawing. The resultant fiber shows a decrease in nonuniformity and has uniform quality. Because neck drawing with a high ratio compared with that obtained by conventional neck drawing can be conducted, a fiber having an extremely thin size that has been hardly produced conventionally can be obtained. Because the fiber can be drawn in the state of a tow and the drawing speed can be increased, the productivity of a conventional fiber can be maintained, or the productivity can be improved and the production cost can be reduced. Furthermore, in order to adjust shrinkage properties, the fiber after superdrawing or neck drawing may be subjected to restricted thermal shrinkage treatment. More specifically, the fiber is preferably subjected to a constant-length heat treatment in such a manner that the fiber length becomes from 0.90 to 1.10 times the one prior to the treatment at temperatures higher than the glass transition points of both of the polymers forming the sea component and the island components. Although the constant-length indicates the case where the fiber length compared with that prior to the treatment does not change at all (1.0 times). However, the fiber, for example, sometimes elongates or shrinks inevitably during the heat treatment. In the constant-length heat treatment of the present invention, the range of a variation in length of the fiber caused by such an elongation or shrinkage is taken into consideration. As a result of comprehensively taking these ranges into consideration, the fiber is preferably subjected to constant-length heat treatment to make the fiber length from 0.90 to 1.10 times the initial fiber length. The treatment is preferred because an unnecessary elongation or shrinkage of the fiber produced in the following steps can be suppressed.

Moreover, in the production method of the islands-in-sea type composite spun fiber of the present invention, neither the neck drawing nor the constant-length heat treatment explained above is conducted sometimes while the applications of the fiber thus obtained are being taken into consideration.

The islands-in-sea type composite spun fiber with an island diameter of 1 μm or less obtained by the above production method can be used as a filaments yarn. Moreover, the fiber can be obtained in the state of a tow by bundling the filaments (from 10 to a few million dtex). Alternatively, islands-in-sea type composite spun short fibers having a fiber length of from 50 μm to 300 mm can be obtained by cutting the tow with a guillotine cutter, a rotary cutter, or the like. Islands-in-sea type composite spun short fibers with a decreased variation in length can also be obtained by increasing the accuracy of the cutter. Next, ultrafine fibers having a diameter of 1 μm or less can be obtained while the productivity comparable to that of conventional fibers is being maintained, by dissolving and removing the sea component under appropriate conditions. Furthermore, because the fiber obtained in the present invention has sufficient strength and elongation, it is extremely useful in fields such as clothing, interiors and synthetic leather.

EXAMPLES

The present invention is specifically explained below by making reference to examples. In addition, various properties of samples in examples were measured by the following methods.

(1) Intrinsic Viscosity (IV)

o-Chlorophenol is used as a solvent, and the intrinsic viscosity of a sample is measured at 35° C. with an Ubbellhode viscometer.

(2) Glass Transition Point ($T_g$), Melting Point ($T_m$)

The $T_g$ and $T_m$ of a sample are measured with Thermal Analyst 2200 (trade name, manufactured by TA Instruments Japan Inc.), at a heating rate of 20° C./min.

(3) Fineness

The fineness is measured in accordance with the method described in JIS L 1013 7.3 Simple Method. In addition, the fineness of ultrafine fibers (fibers of island components) is similarly measured in the state of an island fiber bundle after extraction of the sea component, and the fineness is calculated by dividing the measured value by the number of the island components.

(4) Fiber Diameter

The cross section of a fiber to be measured is measured with a scanning electron microscope (SEM). When the SEM has a length-measuring function, the diameter is measured by utilizing the function. When the SEM has no such function, an enlarged copy of a photograph of the cross section is prepared, and the diameter is measured from the copy with a ruler while a reduction in scale is taken into consideration.

In addition, the fiber diameter is defined as the average of the major axis and the minor axis in a fiber cross section of the fiber.

(5) Qualitative and Quantitative Analyses of the Copolymerized Components of a Copolymerized Polyester A fiber sample is dissolved in a 1/1 solvent mixture of deuterized trifluoroacetic acid/deuterized chloroform, and the nuclear magnetic resonance spectrum ($^1$H-NMR) is measured using JEOL A-600 superconductive FT-NMR (manufactured by JEOL Ltd.). The qualitative and quantitative evaluations are made from the spectrum pattern by the conventional procedure.

Furthermore, for the evaluation of a poly(ethylene glycol) copolymerization amount, or the like, the following procedure is employed if necessary. In other words, a fiber sample is sealed in a tube with an excessive amount of methanol, and subjected to methanolysis at 260° C. for 4 hours in an autoclave. The decomposed material is subjected to analysis by gas chromatography (HP6890 Series GC System, manufactured by Hewlett-Packard Company), and the amounts of the copolymerization components are quantitatively determined. The weight percentages of the measured amounts based on the measured polymer weight are determined. The qualitative evaluation is also made by comparing the holding time with that of a standard sample.

Example 1

A poly(ethylene terephthalate) (IV=0.64 dl/g, $T_g$=70° C., $T_m$=256° C.) in which diethylene glycol in an amount of 1% by weight based on the total weight of the poly(ethylene terephthalate) was copolymerized was used as island components. A modified poly(ethylene terephthalate) (IV=0.47 dl/g, $T_g$=54° C., $T_m$=251° C.) in which a poly(ethylene glycol) (average molecular weight of 4,000) in an amount of 3% by weight based on the total amount of the modified poly(ethylene terephthalate) and 5-sodiosulfoisophthalic acid in an amount of 6% by mole based on the total repeating units thereof were copolymerized was used as a sea component. A spinneret (the same type as in FIG. 1) having the number of island components of 19 was used, and the sea component polymer and the island component polymer in a sea component:island component weight ratio of 50:50 were spun with an injection amount of 0.75 g/min/nozzle at a spinning speed of 500 m/min to give an undrawn islands-in-sea type composite spun fiber. The composite spun fiber was then superdrawn with a draw ratio of 16 in a hot water bath containing 3% by weight of a potassium salt of lauryl phosphate at a temperature of 95° C. that was higher than the glass transition point of the sea component and the island component polymers by 20° C. or more. The superdrawn fiber was further neck drawn with a draw ratio of 2.5 in a hot water bath at 70° C. The neck drawn fiber was further constant-length heat treated in hot water at 95° C. with the length made 1.0 times the neck drawn fiber length. The total draw ratio was 40, and the fineness of the islands-in-sea type composite spun fiber thus obtained was 0.38 dtex (fiber diameter of 5.9 μm).

In order to dissolve and remove the sea component from the composite spun fiber thus obtained, the fiber was subjected to alkali reduction in an amount of 30% by weight with an aqueous solution at 95° C. containing 4% by weight of NaOH to give ultrafine fibers with the number of filaments of 19 having a fineness of 0.01 dtex (fiber diameter of 960 nm).

Comparative Example 1

An undrawn islands-in-sea type composite spun fiber was obtained in the same manner as in Example 1 except that the spinning speed was set at 80 m/min. However, when the undrawn fiber was drawn under the same conditions as in Example 1, the fiber was melted and broken, and the drawing was impossible.

Comparative Example 2

An undrawn islands-in-sea type composite spun fiber was obtained in the same manner as in Example 1 except that the spinning speed was set at 1,200 m/min. However, superdrawing of the fiber did not take place in hot water at 95° C., resulting in neck drawing of the fiber. Consequently, the maximum total draw ratio remained 4. The fineness of the islands-in-sea type composite spun fiber thus obtained was therefore 1.6 dtex (a fiber diameter of 12 μm), and the fineness of the fiber after alkali reduction with the aqueous NaOH solution was 0.04 dtex (a fiber diameter of 1,900 nm).

Comparative Example 3

An undrawn islands-in-sea type composite spun fiber was obtained in the same manner as in Example 1 except that the spinning speed was set at 150 m/min. However, when superdrawing of the undrawn fiber with a draw ratio of 110 was tried, the fiber was melted and broken, and drawing the fiber was impossible.

Example 2

A poly(ethylene terephthalate) (IV=0.64 dl/g, $T_g$=70° C., $T_m$=256° C.) in which diethylene glycol in an amount of 1% by weight based on the total weight of the poly(ethylene terephthalate) was copolymerized was used as island components. A modified poly(ethylene terephthalate) (IV=0.41 dl/g, $T_g$=53° C., $T_m$=215° C.) in which a poly(ethylene glycol) (average molecular weight of 4,000) in an amount of 3% by weight based on the total weight of the modified poly(ethylene terephthalate) and 5-sodiosulfoisophthalic acid in an amount of 9% by mole based on the total repeating units thereof were copolymerized was used as a sea component. A spinneret (the same type as in FIG. 1) having the number of island components of 1,000 was used, and the sea component polymer and the island component polymer in a sea component:island component weight ratio of 30:70 were spun with an injection amount of 0.75 g/min/nozzle at a spinning speed of 500 m/min to give an undrawn islands-in-sea type composite spun fiber. The fiber was then superdrawn with a draw ratio of 16 in a hot water bath containing 3% by weight of a potassium salt of lauryl phosphate at a temperature of 95° C. that was higher than the glass transition point of the sea component and the island component polymers by 20° C. or more. The superdrawn fiber was further neck drawn with a draw ratio of 2.5 in a hot water bath at 70° C. The neck drawn fiber was further subjected to constant-length heat treatment in hot water at 95° C. with the length made 1.0 times the length of the neck drawn fiber. The total draw ratio was 40, and the fineness of the islands-in-sea type composite spun fiber thus obtained was 0.38 dtex (a fiber diameter of 5.9 μm).

In order to dissolve and remove the sea component from the composite spun fiber thus obtained, the composite spun fiber was subjected to alkali reduction in an amount of 30% by weight with an aqueous solution at 95° C. containing 4% by weight of NaOH to give ultrafine fibers with the number of filaments of 1,000 having a fineness of 0.00027 dtex (a fiber diameter of 160 nm).

Example 3

A poly(ethylene terephthalate) (IV=0.43 dl/g, $T_g$=70° C., $T_m$=256° C.) in which diethylene glycol in an amount of 1% by weight based on the total weight of the poly(ethylene terephthalate) was copolymerized was used as island components. A modified poly(ethylene terephthalate) (IV=0.41 dl/g, $T_g$=53° C., $T_m$=215° C.) in which a poly(ethylene glycol) (average molecular weight of 4,000) in an amount of 3% by weight based on the total weight of the modified poly(ethylene terephthalate) and 5-sodiosulfoisophthalic acid in an amount of 9% by mole based on the total repeating units thereof were copolymerized was used as a sea component. A spinneret (the same type as in FIG. 1) having the number of island components of 1,000 was used, and the sea component polymer and the island component polymer in a sea component:island component weight ratio of 50:50 were spun with an injection amount of 0.75 g/min/nozzle at a spinning speed of 500 m/min to give an undrawn islands-in-sea type spun fiber. The composite spun fiber was then superdrawn with a draw ratio of 20 in a hot water bath containing 3% by weight of potassium salt of lauryl phosphate at a temperature of 85° C. that was higher than the glass transition point of the sea component and the island component polymers by 10° C. or more. The superdrawn fiber was further neck drawn with a draw ratio of 2.5 in a hot water bath at 70° C. The neck drawn fiber was further constant-length heat treated in hot water at 95° C. with the length made 1.0 times the neck drawn fiber length. The total draw ratio was 50, and the fineness of the islands-in-sea type composite spun fiber thus obtained was 0.3 dtex (fiber diameter of 5.3 μm).

In order to dissolve and remove the sea component from the composite spun fiber thus obtained, the fiber was subjected to alkali reduction in an amount of 30% by weight with an aqueous solution at 95° C. containing 4% by weight of NaOH to give ultrafine fibers with the number of filaments of 1,000 having a fineness of 0.00015 dtex (fiber diameter of 118 nm).

Comparative Example 4

The procedure of Example 1 was repeated except that the temperature of the hot water bath where superdrawing was conducted was set at 69° C. However, superdrawing of the composite spun fiber did not take place, and the fiber was neck drawn. The maximum total draw ratio therefore remained 4.58. Accordingly, the fineness of the islands-in-sea type composite spun fiber was 3.2 dtex (fiber diameter of 17 μm), and the fineness after alkali reduction with an aqueous NaOH solution was 0.083 dtex (fiber diameter of 2,700 nm).

Example 4

A poly(ethylene terephthalate) (IV=0.43 dl/g, $T_g$=70° C., $T_m$=256° C.) in which diethylene glycol in an amount of 0.6% by weight based on the total weight of the poly(ethylene terephthalate) was copolymerized was used as island components. A modified poly(ethylene terephthalate) (IV=0.47 dl/g, $T_g$=54° C., $T_m$=251° C.) in which a poly(ethylene glycol) (average molecular weight of 4,000) in an amount of 3% by weight based on the total weight of the modified poly(ethylene terephthalate) and 5-sodiosulfoisophthalic acid in an amount of 6% by mole based on the total repeating units thereof were copolymerized was used as a sea component. A spinneret (the same type as in FIG. 1) having 19 island components was used, and the sea component polymer and the island component polymer in a sea component:island component weight ratio of 50:50 were spun with an injection amount of 0.60 g/min/nozzle at a spinning speed of 500 m/min to give an undrawn islands-in-sea type composite spun fiber. The composite spun fiber was then superdrawn with a draw ratio of 22 in a hot water bath containing 3% by weight of a potassium salt of lauryl phosphate at a temperature of 91° C. that was higher than the glass transition point of the sea component and the island component polymers by 20° C. or more. The superdrawn fiber was further neck drawn with a draw ratio of 2.0 in a hot water bath at 63° C. The neck drawn fiber was further constant-length heat treated in hot water at 90° C. with the length made 1.0 times the neck drawn fiber length. The total draw ratio was 44, and the fineness of the islands-in-sea type composite spun fiber thus obtained was 0.28 dtex (fiber diameter of 5.0 μm).

In order to dissolve and remove the sea component from the composite spun fiber thus obtained, the fiber was subjected to alkali reduction in an amount of 30% by weight with an aqueous solution at 95° C. containing 4% by weight of NaOH to give ultrafine fibers with the number of filaments of 19 having a fineness of 0.0073 dtex (fiber diameter of 810 nm).

Example 5

The procedure of Example 4 was repeated except that the constant-length heat treatment was conducted with the length made 0.9 times the neck drawn fiber length. The islands-in-sea type composite spun fiber thus obtained had a fineness of 0.31 dtex (fiber diameter of 5.3 μm), and gave ultrafine fibers with the number of filaments of 19 having a fineness of 0.0081 dtex (fiber diameter of 850 nm) when subjected to alkali reduction in an amount of 30% by weight with an aqueous solution at 95° C. containing 4% by weight of NaOH.

Example 6

The procedure of Example 4 was repeated except that the constant-length heat treatment was conducted with the length made 1.1 times the neck drawn fiber length. The islands-in-sea type composite spun fiber thus obtained had a fineness of 0.25 dtex (fiber diameter of 4.8 μm), and gave ultrafine fibers with the number of filaments of 19 having a fineness of 0.0066 dtex (fiber diameter of 770 nm) when subjected to alkali reduction in an amount of 30% by weight with an aqueous solution at 95° C. containing 4% by weight of NaOH.

Example 7

The procedure of Example 4 was repeated except that a spinneret having 37 island components was used. The islands-in-sea type composite spun fiber thus obtained had a fineness of 0.28 dtex (fiber diameter of 5.0 μm), and gave ultrafine fibers with the number of filaments of 37 having a fineness of 0.0038 dtex (fiber diameter of 580 nm) when subjected to alkali reduction in an amount of 30% by weight with an aqueous solution at 95° C. containing 4% by weight of NaOH.

Example 8

The procedure of Example 5 was repeated except that neck drawing after superdrawing and the constant-length heat treatment were omitted. The islands-in-sea type composite spun fiber thus obtained had a fineness of 0.78 dtex (fiber diameter of 8.4 μm), and gave ultrafine fibers with the number of filaments of 19 having a fineness of 0.011 dtex (fiber diameter of 975 nm) when subjected to alkali reduction in an amount of 30% by weight with an aqueous solution at 95° C. containing 4% by weight of NaOH.

Example 9

The procedure of Example 7 was repeated except that neck drawing after superdrawing alone was omitted (the other operations such as constant-length heat treatment in hot water at 90° C. with the length made 1.0 times being conducted).

The islands-in-sea type composite spun fiber thus obtained had a fineness of 0.78 dtex (fiber diameter of 8.4 μm), and gave ultrafine fibers with the number of filaments of 37 having a fineness of 0.011 dtex (fiber diameter of 975 nm) when subjected to alkali reduction in an amount of 30% by weight with an aqueous solution at 95° C. containing 4% by weight of NaOH.

Example 10

The procedure of Example 2 was repeated except that a spinneret having 10 island components was used. The islands-in-sea type composite spun fiber thus obtained had a fineness of 0.17 dtex (fiber diameter of 3.9 μm), and gave ultrafine fibers with the number of filaments of 10 having a fineness of 0.0090 dtex (fiber diameter of 880 nm) when subjected to alkali reduction in an amount of 30% by weight with an aqueous solution at 95° C. containing 4% by weight of NaOH.

Example 11

The procedure of Example 2 was repeated except that a spinneret having 2,000 island components was used. The islands-in-sea type composite spun fiber thus obtained had a fineness of 0.38 dtex (fiber diameter of 5.9 μm), and gave ultrafine fibers with the number of filaments of 2,000 having a fineness of 0.00010 dtex (fiber diameter of 93 nm) when subjected to alkali reduction in an amount of 30% by weight with an aqueous solution at 95° C. containing 4% by weight of NaOH.

Example 12

The procedure of Example 2 was repeated except that a spinneret having 100 island components was used, and that the proportion of the island components was made 90% by weight. The islands-in-sea type composite spun fiber thus obtained had a fineness of 0.38 dtex (fiber diameter of 5.9 μm), and gave ultrafine fibers with the number of filaments of 100 having a fineness of 0.0034 dtex (fiber diameter of 557 nm) when subjected to alkali reduction in an amount of 30% by weight with an aqueous solution at 95° C. containing 4% by weight of NaOH.

Example 13

The procedure of Example 12 was repeated except that the proportion of the island components was made 20% by weight. The islands-in-sea type composite spun fiber thus obtained had a fineness of 0.38 dtex (fiber diameter of 5.9 μm), and gave ultrafine fibers with the number of filaments of 100 having a fineness of 0.00077 dtex (fiber diameter of 262 nm) when subjected to alkali reduction in an amount of 30% by weight with an aqueous solution at 95° C. containing 4% by weight of NaOH.

INDUSTRIAL APPLICABILITY

The present invention makes it possible to produce with high productivity a filament yarn having a diameter at the level of nanometers, or short fibers having an optional fiber length. Moreover, nanofibers that can be obtained only in a nonwoven fabric state in which fiber-to-fiber spaces are fixed can now be easily formed into a woven or knitted fabric, or easily stacked to give a nonwoven fabric or a fiber structure. Extraction of ultrafine fibers by alkali reduction becomes easy and a parent fiber having a finer size can be obtained by preparing an islands-in-sea type composite spun fiber from two polyesters differing from each other in an alkali reduction rate that cannot be obtained from a polymer alloy system. Moreover, because a parent fiber having a finer size can be obtained, the islands-in-sea type composite spun fiber has the advantage that, for example, a wet type nonwoven fabric, or the like, prepared therefrom has highly uniform fiber dispersibility.

The invention claimed is:

1. A method of producing an islands-in-sea type composite spun fiber having an island component diameter of 1 μm or less, the method comprising drawing with a total draw ratio of from 40 to 100 an undrawn islands-in-sea type composite spun fiber that has been spun at a spinning speed of from 100 to 1,000 m/min at temperatures higher than the glass transition points of both of the polymers forming the sea component and the island components of the islands-in-sea type composite spun fiber, wherein the number of island components is from 10 to 2,000.

2. The method of producing an islands-in-sea type composite spun fiber according to claim 1, wherein after the drawing, the islands-in-sea type composite spun fiber is subjected to a constant-length heat treatment at temperatures higher than the glass transition points of both of the polymers forming the sea component and the island components of the islands-in-sea type composite spun fiber with a fiber length made from 0.90 to 1.10 times the drawn fiber length.

3. The method of producing an islands-in-sea type composite spun fiber according to claim 1, wherein after the drawing, the islands-in-sea type composite spun fiber is additionally drawn (neck drawn).

4. The method of producing an islands-in-sea type composite spun fiber according to claim 3, wherein after the neck drawing, the fiber is subjected to constant-length heat treatment with the fiber length made from 0.90 to 1.10 times the neck drawn fiber length at temperatures higher than the glass transition points of both of the polymers forming the sea component and the island components of the islands-in-sea type composite spun fiber.

5. The method of producing an islands-in-sea type composite spun fiber according to claim 1, wherein after the drawing, the islands-in-sea type composite spun fiber is subjected to neither constant-length heat treatment with the length made from 0.90 to 1.10 times the drawn fiber length at temperatures higher than the glass transition points of both of the polymers forming the sea component and the island components of the islands-in-sea type composite spun fiber, nor additional drawing (neck drawing).

6. The method of producing an islands-in-sea type composite spun fiber according to any one of claim 1 to 5, wherein the drawing is conducted at temperatures higher than the glass transition points of both of the polymers forming the sea component and the island components of the islands-in-sea type composite spun fiber by 10° C. or more.

7. The method of producing an islands-in-sea type composite spun fiber according to claim 1, wherein both of the polymer forming the sea component and the polymer forming the island components contain a polyester polymer.

8. The method of producing an islands-in-sea type composite spun fiber according to claim 7, wherein the polymer forming the sea component is a poly(ethylene terephthalate) copolymerized polyester in which an alkali metal of 5-sulfoisophthalic acid and/or a poly(ethylene glycol) is copolymerized, and the polymer forming the island components is a poly(ethylene terephthalate) copolymerized polyester in which a poly(ethylene terephthalate) or isophthalic acid and/or an alkali metal salt of 5-sulfoisophthalic acid is copolymerized.

* * * * *